US007255429B2

(12) United States Patent
Ito

(10) Patent No.: US 7,255,429 B2
(45) Date of Patent: Aug. 14, 2007

(54) INKJET PRINT HEAD

(75) Inventor: Atsushi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 318 days.

(21) Appl. No.: 10/916,276

(22) Filed: Aug. 11, 2004

(65) Prior Publication Data

US 2005/0035994 A1 Feb. 17, 2005

(30) Foreign Application Priority Data

Aug. 12, 2003 (JP) ..... 2003-292029

(51) Int. Cl.
*B41J 2/045* (2006.01)

(52) U.S. Cl. ..... 347/71; 347/72

(58) Field of Classification Search ..... 347/71, 347/72, 40

See application file for complete search history.

(56) References Cited

U.S. PATENT DOCUMENTS

| | | | | |
|---|---|---|---|---|
| 5,402,159 | A | 3/1995 | Takahashi et al. | |
| 5,963,234 | A * | 10/1999 | Miyazawa et al. | 347/70 |
| 6,648,452 | B2 | 11/2003 | Ito | |
| 2002/0175976 | A1 | 11/2002 | Okuda | |

FOREIGN PATENT DOCUMENTS

| | | | |
|---|---|---|---|
| EP | 0 759 361 A | 2/1997 | |
| EP | 1 057 633 A1 | 12/2000 | |
| JP | 4341853 | 11/1992 | |
| JP | 11-254681 | 9/1999 | |
| JP | 2002-137386 | 5/2002 | |

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

An inkjet print head including a cavity unit which defines: (a) a plurality of nozzles; (b) pressure chambers arranged in a row or rows to be held in communication with the respective nozzles; and (c) at least one common chamber which stores an ink to refill the pressure chambers. Each common chamber is elongated along the corresponding row of the pressure chambers, such that the pressure chambers arranged in the corresponding row overlap the common chamber as viewed in the vertical direction. At least one of the pressure chambers arranged in the corresponding row overlaps the common chamber differently from the other pressure chambers arranged in the corresponding row. The cavity unit further defines at least one open-space chamber located between the pressure chambers and the common chamber or chambers in the vertical direction. Each open-space chamber overlaps the pressure chambers arranged in the corresponding row, as viewed in the vertical direction, such that the pressure chambers arranged in the corresponding row overlap the open-space chamber, equally with each other.

13 Claims, 4 Drawing Sheets

FIG.4A PRIOR ART
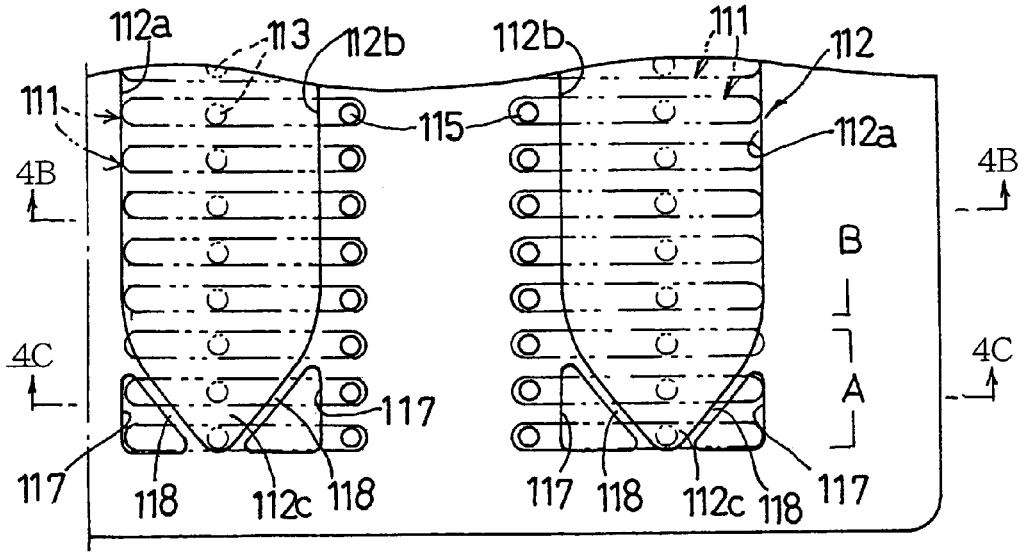
FIG.4B PRIOR ART
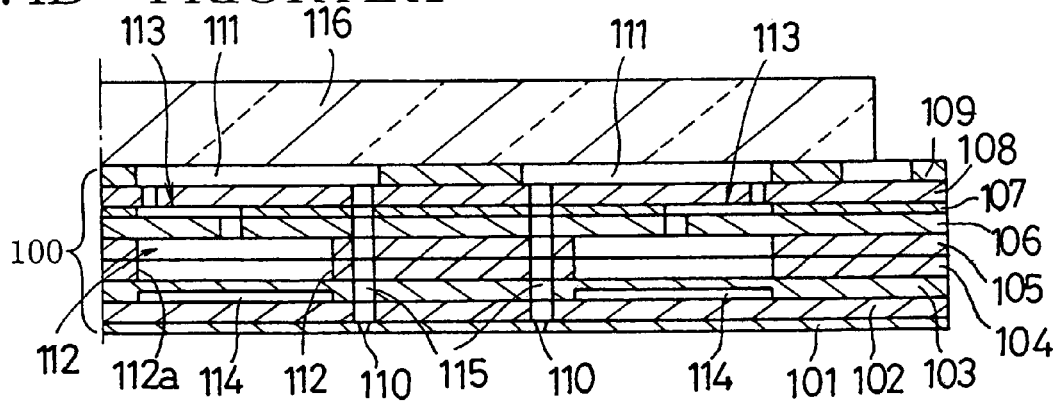
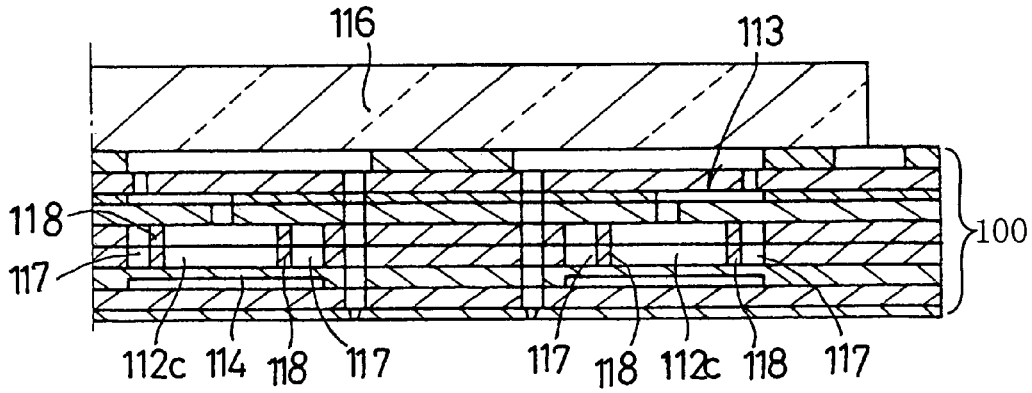
FIG.4C PRIOR ART

INKJET PRINT HEAD

This application is based on Japanese Patent Application No. 2003-292029 filed in Aug. 12, 2003, the content of which is incorporated hereinto by reference.

BACKGROUND OF THE INVENTION

1. Field of the Invention

The present invention relates in general to an inkjet print head, and more particularly to the construction of an inkjet print head having nozzles arranged in rows.

2. Discussion of Related Art

A prior art inkjet print head of on-demand type, as disclosed in JP-A-2002-137386 and U.S. Pat. No. 6,648,452, for example, includes a cavity unit 100 consisting of a plurality of plates 101-109 superposed on each other so as to define ink delivery passages, as shown in FIGS. 4A-4C showing a portion of the cavity unit 100 which portion is located on the right side of a widthwise center line of the cavity unit 100. These plates consist of: a nozzle plate 101 defining a plurality of nozzles 110 which are arranged in a total of four rows (only two of the four rows are shown in FIGS. 4A-4C); a base plate 109 defining a plurality of pressure chambers 111 which are also arranged in a total of four rows and each of which is held in communication at one of its opposite end portions with a corresponding one of the nozzles 110; two manifold plates 104, 105 defining common chambers 112 each of which is held in communication at one of its opposite end portions with an ink supply source; three spacer plates 106, 107, 108 interposed between the base plate 109 and the two manifold plates 104, 105 and cooperating with each other to define a plurality of ink delivery passages 113 each of which communicates with a corresponding one of the common chambers 112 and the other of the above-described opposite end portions of a corresponding one of the pressure chambers 111; a damper plate 103 defining damper chambers 114 which are located below the respective common chambers 112; and a spacer plate 102 interposed between the damper plate 103 and the nozzle plate 101. It is noted that each of the pressure chambers 111 is held in communication at the above-described one end portion with the corresponding nozzle 110 through a corresponding one of ink delivery passages 115 which are formed through the plates 102-108.

The inkjet print head further includes a piezoelectric actuator unit 116 which has piezoelectric ceramic plates, and internal electrodes in the form of common electrodes and arrays of individual electrodes formed on the piezoelectric ceramic plates such that the common electrodes and the individual electrode arrays are alternately superposed on each other. The piezoelectric actuator unit 116 and the cavity unit 100 are bonded together such that active portions existing between the common electrodes and the respective individual electrodes are aligned with the respective pressure chambers 111.

Each of the common chambers 112 formed in the manifold plates 104, 105 is elongated in a direction parallel with the rows of the nozzles 110 and the rows of the pressure chambers 111, and lies on a plane parallel with a plane defined by the rows of the pressure chambers 111 formed in the base plate 109. Each of the pressure chambers 111 is elongated in a direction perpendicular to the longitudinal direction of the common chambers 112. Each pressure chamber 111 has a portion which overlaps a corresponding one of the common chambers 112 as viewed in a plan view of the cavity unit 100, as shown in FIG. 4A.

Each common chamber 112 is held in communication at one of its longitudinally opposite end portions (not shown) with an ink supply source (not shown) via an ink supply hole (not shown) which is formed through the spacer plates 106-108. The common chamber 112 has, in its longitudinally intermediate portion, widthwise opposite ends 112*a*, 112*b* which are both parallel with the rows of the pressure chambers 111, so that a cross sectional area of the common chamber 112 is constant in the longitudinally intermediate portion. A major portion of each pressure chamber 111 overlaps the longitudinally intermediate portion of the common chamber 112. However, the cross sectional area of the common chamber 112 is gradually reduced in the other 112*c* of the longitudinally opposite end portions and its vicinity. That is, in the other end portion 112*c* and its vicinity, the cross sectional area is gradually reduced as viewed in a direction away from the above-described ink supply hole. This reduction of the cross sectional area in a region indicated by reference sign A is intended for facilitating discharge of bubbles (which tend to remain in the other end portion 112*c* of the common chamber 112) out of the common chamber 112 toward the corresponding pressure chamber 111 and nozzle 110.

Owing to the above-described arrangement in which the cross sectional area of the common chamber 112 is constant in a region indicated by reference sign B while the cross sectional area of the common chamber 112 is gradually reduced in the region A, each of the manifold plates 104, 105 is given a rigidity which is not constant. That is, the rigidity of each of the manifold plates 104, 105 is relatively high in the region A, while being relatively low in the region B.

In the cavity unit 100 as constructed as described above, when a pressure in the pressure chambers 111 is increased with activations of the active portions of the actuator unit 116 for ejecting an ink through the nozzles 110, the volume of each pressure chamber 111 located in the region A (in which the rigidity of each of the manifold plates 104, 105 is relatively high) and the volume of each pressure chamber 111 located in the region B (in which the rigidity of each of the manifold plates 104, 105 is relatively low) are changed differently from each other, so that the nozzles 110 exhibit respective ink ejecting performances which are different from each other and which are dependent on the locations of the respective pressure chambers 111.

In the inkjet print head disclosed in the above-identified Japanese and U.S. publications, a pair of open-space chambers 117 are formed in the manifold plates 104, 105, so as to be adjacent to a portion of the common chamber 112 which is located in the region A and in which the cross sectional area of the common chamber 112 is gradually reduced. The formations of the open-space chambers 117 are intended to reduce the rigidity of the manifold plates 104, 105 in the region A, namely, to substantially equalize the rigidity of the manifold plates 104, 105 in the region A and the rigidity of the manifold plates 104, 105 in the region B to each other.

The formations of the open-space chambers 117 cannot satisfactorily equalize the rigidity in the region A and the rigidity in the region B to each other. In the region B, since the pressure chambers 111 overlap the common chamber 112 equally with each other as viewed in the plan view of the cavity unit 100, the pressure chambers 111 can be deformed substantially equally with each other when the pressure in the pressure chambers 111 is increased as a result of activations of the active portions of the actuator unit 116. Further, in the region B, since each pressure chamber 111 except one of its longitudinally opposite end portions is located between the widthwise opposite ends 112*a*, 112*b* of the common chamber 112 as viewed in the plan view, each pressure chamber 111 can be deformed substantially evenly over its substantially entire length, upon activations of the respective active portions of the actuator unit 116. However, in the region A, since the pressure chambers 111 overlap the common chamber 112 differently from each other, as viewed in the plan view, the pressure chambers 111 deform differently from each other upon activations of the respective active portions of the actuator unit 116. Further, in the region A, since each pressure chamber 111 overlaps not only the common chamber 112 and the open-space chambers 117 but also thin partition walls 118 which are interposed between the common chamber 112 and the open-space chambers 117, the spacer plates 106-108 are partially supported by the thin partition walls 118, whereby the spacer plates 106-108 are partially restrained by the thin partition walls 118, from being downwardly deformed. Thus, each pressure chamber 111 in the region A cannot be deformed substantially evenly in its entirety, upon activations of the respective active portions of the actuator unit 116. Consequently, the ink ejection performance exhibited by each nozzle 110 located in the region A and that exhibited by each nozzle 110 located in the region B are different from each other, thereby leading to undesirable variation in the image formation performance of the inkjet print head.

SUMMARY OF THE INVENTION

The present invention was made in view of the background prior art discussed above. It is therefore an object of the invention to provide an inkjet print head capable of forming a desired image with high stability or reliability. This object may be achieved according to either a first or a second aspect of the invention which is described below.

The first aspect of the invention provides an inkjet print head comprising a cavity unit and an actuator unit which are superposed on each other, wherein the cavity unit defines (a) a plurality of nozzles which are open in a nozzle opening surface of the cavity unit and which are arranged in at least one row, (b) a plurality of pressure chambers which are positioned in vicinity of the actuator unit and which are arranged in at least one row so as to be held in communication with the respective nozzles, and (c) at least one common chamber which stores an ink supplied from an ink supply source and refills the pressure chambers, wherein the actuator unit has a plurality of active portions which correspond to the pressure chambers, respectively, and which are selectively operable to eject the ink through the respective nozzles, wherein each of the above-described at least one common chamber is elongated in a direction substantially parallel with a corresponding one of the above-described at least one row of the pressure chambers, such that the plurality of pressure chambers arranged in the corresponding one of the above-described at least one row overlap the each of the above-described at least one common chamber as viewed in a direction perpendicular to the nozzle opening surface of the cavity unit, wherein the each common chamber is shaped such that at least one of the plurality of pressure chambers arranged in the corresponding row overlaps the each common chamber differently from the other of the plurality of pressure chambers arranged in the corresponding row, wherein the cavity unit further defines at least one open-space chamber which is located between the pressure chambers and the above-described at least one common chamber in the direction perpendicular to the nozzle opening surface of the cavity unit, and which is isolated from the pressure chambers and the above-described at least one common chamber, and wherein each of the above-described at least one open-space chamber overlaps the plurality of pressure chambers arranged in a corresponding one of the above-described at least one row, as viewed in the direction perpendicular to the nozzle opening surface of the cavity unit, such that the pressure chambers arranged in the corresponding one of the above-described at least one row overlap the each of the above-described at least one open-space chamber substantially equally with each other.

In an operation in the present inkjet print head constructed according to the first aspect of the invention, the ink accommodated in a selected one or ones of the pressure chambers is given an ejection energy by activation of the corresponding active portion or portions of the actuator unit, whereby the ink is delivered from the selected one or ones of the pressure chambers to the corresponding nozzle or nozzles, and is then ejected as droplets through the nozzle or nozzles, onto a print medium, so that an image in the form of ink dots is printed on the print medium.

In this instance, as a result of increase in the pressure in the selected one or ones of the pressure chambers with the activation of the corresponding active portion or portions of the actuator unit, the cavity unit is forced to be elastically deformed at its portion or portions located between the selected pressure chamber or chambers and the corresponding common chamber or chambers. In the present inkjet print head, the elastic deformation of the above-described portion or portions of the cavity unit is absorbed by the corresponding open-space chamber or chambers with which the pressure chambers arranged in the corresponding row or rows overlap equally with each other as viewed in the direction perpendicular to the nozzle opening surface of the cavity unit. Therefore, owing to the open-space chamber or chambers located between the pressure chambers and the common chamber or chambers, each portion of the cavity unit located between the corresponding row of the pressure chambers and the corresponding common chamber is given a rigidity which is constant over its substantially entire length, namely, which is constant as viewed in the direction of the row of the pressure chambers. This arrangement is effective to minimize a difference among the pressure chambers with respect to their volumetric and pressure changes which are caused by the activation of the respective active portions of the actuator unit, thereby making it possible to substantially equalize the ink ejecting performances of the respective nozzles with each other, irrespective of the locations of the corresponding pressure chambers. It should be noted that the constancy in the rigidity of the above-described portion of the cavity unit is established owing to the presence of the open-space chamber or chambers, and is affected neither by the shape and dimensions of the common chamber or chambers nor by the position of the common chamber or chambers relative to the pressure chambers. That is, the pressure chambers arranged in each row do not have to necessarily overlap the corresponding common chamber equally with each other as viewed in the direction perpendicular to the nozzle opening surface. The consistency in the rigidity of the above-described portion of the cavity unit is not deteriorated even where each common chamber is shaped to have a cross section whose area is gradually reduced as viewed in a direction away from one of its longitudinally opposite end portion (in which the common chamber is held in communication with the ink supply source) toward the other of the longitudinally opposite end portion. This advantage increases freedom in designing each common chamber.

According to the second aspect of the invention, in the inkjet print head defined in the first aspect of the invention, a distance between the above-described at least one open-space chamber and the above-described at least one common chamber as measured in the direction perpendicular to the nozzle opening surface of the cavity unit is smaller than a distance between the above-described at least one open-space chamber and the plurality of pressure chambers as measured in the direction perpendicular to the nozzle opening surface.

When the pressure in a selected one or ones of the pressure chambers is increased with the activation of the corresponding active portion or portions of the actuator unit, the increased pressure could be transmitted to other pressure chambers adjacent to the selected pressure chambers, thereby possibly inducing a so-called "cross talk" between the adjacent pressure chambers in a conventional inkjet print head. In the present inkjet print head constructed according to the second aspect of the invention, however, since the above-described at least one open-space chamber is located between the pressure chambers and the above-described at least one common chamber such that the above-described at least one open-space chamber is closer to the above-described at least one common chamber than to the pressure chambers as measured in the direction perpendicular to the nozzle opening surface, it is possible to reduce a thickness of a portion of a common-chamber surrounding wall (which surrounds each common chamber), which portion is adjacent to the corresponding open-space chamber, thereby facilitating an elastic deformation of this portion of the common-chamber surrounding wall. In this arrangement, therefore, even if the above-described increased pressure is transmitted to the corresponding common chamber, the pressure increase can be damped or absorbed by an increase of the volume of the common chamber, whereby an occurrence of the problematic cross talk is reduced.

Further, when the volume of the selected pressure chamber or chambers as a result of increase in the pressure in the selected pressure chamber or chambers, the cavity unit is elastically deformed, at the above-described portion or portions located between the selected pressure chamber or chambers and the corresponding common chamber or chambers, in a direction toward the corresponding common chamber or chambers. In this instance, the volume of the corresponding common chamber or chambers is reduced by such a deformation of the cavity unit, thereby causing the cross talk in a conventional inkjet print head. That is, due to reduction in the volume of the common chamber or chambers, the increased pressure in the selected pressure chamber or chambers is transmitted to the adjacent pressure chambers. In the present inkjet print head constructed according to the second aspect of the invention, however, since the elastic deformation of the above-described portion or portions of the cavity unit is absorbed by the corresponding open-space chamber or chambers, as described above, it is possible to restrain the reduction in the volume of the common chamber or chambers, thereby effectively restraining occurrence of the cross talk due to the volume reduction of the common chamber or chambers.

Still further, in the present inkjet print head having an arrangement in which the above-described at least one open-space chamber is closer to the above-described at least one common chamber than to the pressure chambers, the pressure in each pressure chamber can be increased by the activation of the corresponding active portion of the actuator unit, more efficiently than in an arrangement in which the above-described at least one open-space chamber is closer to the pressure chambers than to the above-described at least one common chamber.

For providing the above-described technical advantages more reliably, the distance between the above-described at least one open-space chamber and at least one common chamber is preferably smaller than a half of the distance between the above-described at least one open-space chamber and pressure chambers, and is more preferably smaller than one-third of the distance between the above-described at least one open-space chamber and pressure chambers.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIG. 4A is a plan view of a part of a cavity unit of a conventional inkjet print head of piezoelectric type;

FIG. 4B is an elevational view in cross section taken along line 4B-4B of FIG. 4A; and FIG. 4C is an elevational view in cross section taken along line 4C-4C of FIG. 4A.

DETAILED DESCRIPTION OF THE PREFERRED EMBODIMENT

Figure 1:
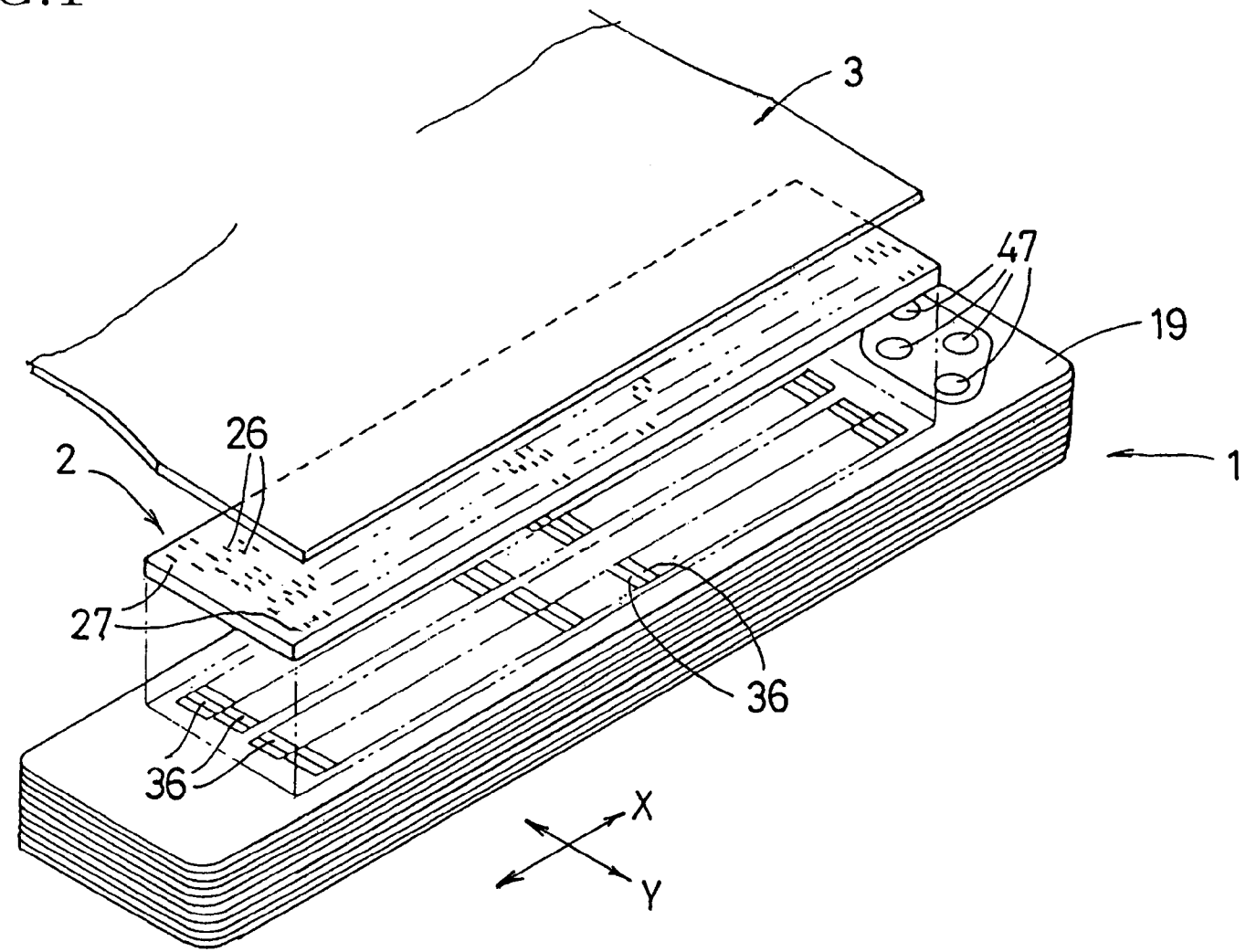
FIG. 1 is a perspective explosive view showing an inkjet print head of piezoelectric type according to an embodiment of this invention.
Figure 2:
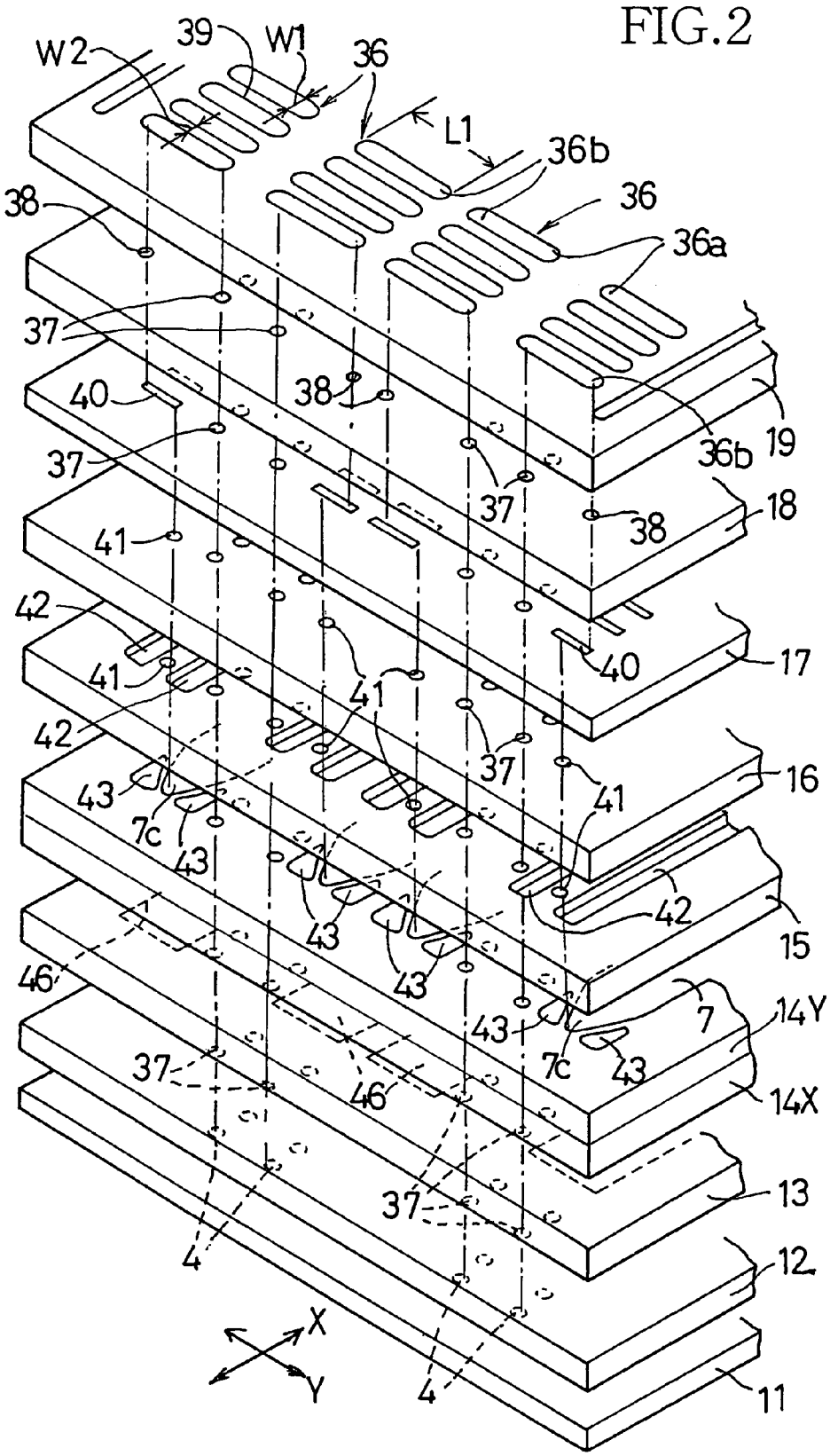
FIG. 2 is a fragmentary perspective explosive view of a cavity unit of the inkjet print head of FIG. 1.

Referring first to FIGS. 1-3, there will be described an inkjet print head of piezoelectric type constructed according to an embodiment of the present invention.

As shown in FIG. 1, the inkjet print head includes a cavity unit 1 and a piezoelectric actuator 2 which are superposed on each other in a vertical direction of the inkjet print head. The piezoelectric actuator 2, which is of a planar type, is bonded to an upper surface of the cavity unit 1, and a flexible flat cable 3 for connection with an external device is superposed on and bonded to an upper surface of the piezoelectric actuator 2. The cavity unit 1 has a lower surface provided by a lowermost one (i.e., nozzle plate) of the plates. The lower surface of the cavity unit serves as a nozzle opening surface in which a multiplicity of nozzles 4 are open, so that an ink is downwardly ejected through the nozzles 4.

The cavity unit 1 is constructed as shown in FIGS. 2 and 3. Described in detail, the cavity unit 1 is a laminar structure consisting of a total of ten relatively thin plates superposed on each other and bonded together by an adhesive. The ten thin plates consist of a nozzle plate 11, a first spacer plate 12, a damper plate 13, two manifold plates 14X, 14Y, a second spacer plate 15, a third spacer plate 16, a fourth spacer plate 17, a fifth spacer plate 18 and a base plate 19.

In the present embodiment, the nozzle plate 11 is formed of a synthetic resin, while each of the other plates 12-19 is formed of a steel alloy including 42% of nickel and has a thickness of about 50-150 μm. Each of the nozzles 4, formed through the nozzle plate 11, has an extremely small diameter (about 25 μm in this embodiment). The nozzles 4 are arranged at a predetermined small pitch in four parallel rows extending in a first direction (i.e., in a longitudinal direction of the cavity unit 1, which is an X-axis direction indicated in FIGS. 1, 2 and 3A), such that the nozzles 4 in the respective two adjacent rows are arranged in a zigzag pattern, while the nozzles 4 in the respective two other adjacent rows are also arranged in a zigzag pattern.

In the base plate 19 (which is an uppermost one of the plates), a multiplicity of pressure chambers 36 are formed to be arranged in four parallel rows extending in the above-described first direction, as shown in FIGS. 1 and 2, such that the pressure chambers 36 in the respective two adjacent rows are arranged in a zigzag pattern, while the pressure chambers 36 in the respective two other adjacent rows are also arranged in a zigzag pattern, like the nozzles 4. Each of the pressure chambers 36 is elongated in a second direction (i.e., in a width direction of the cavity unit 1, which is a Y-axis direction indicated in FIGS. 1, 2 and 3A).

Figure 3A:
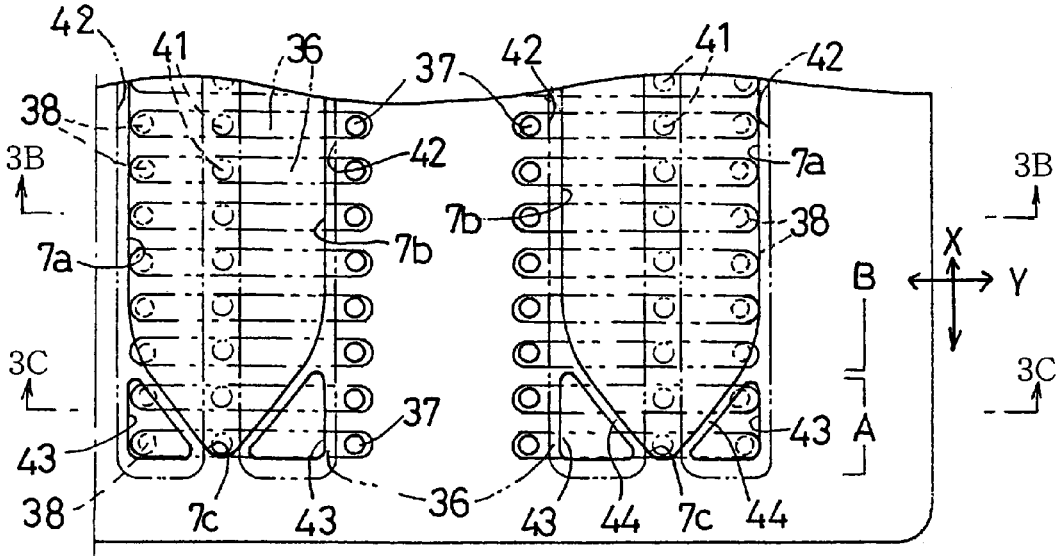
FIG. 3A is a plan view of a part of the cavity unit of the inkjet print head of FIG. 1.
Figure 3B:
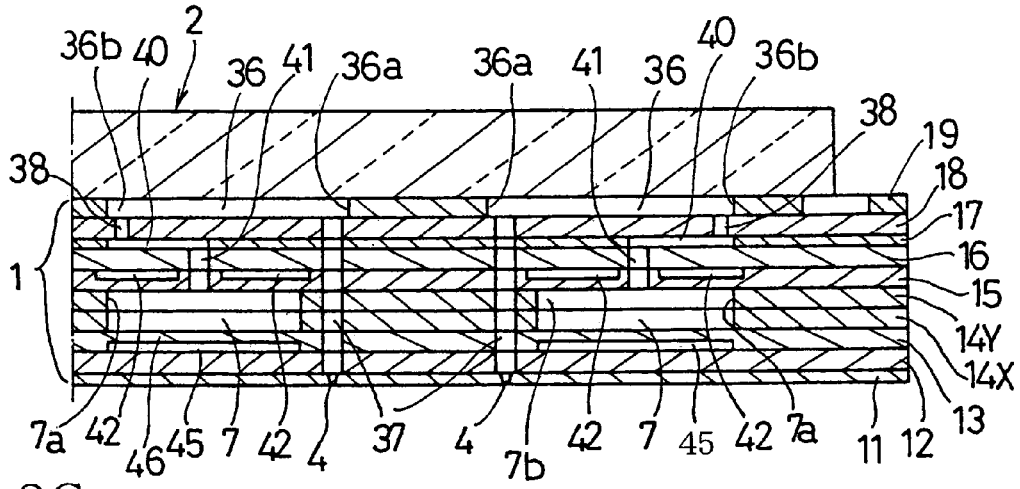
FIG. 3B is an elevational view in cross section taken along line 3B-3B of FIG. 3A.
Figure 3C:
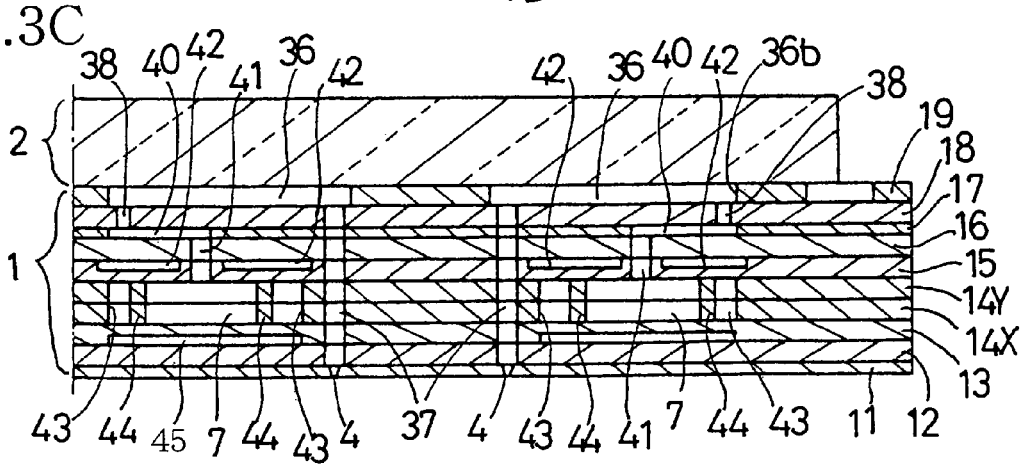
FIG. 3C is an elevational view in cross section taken along line 3C-3C of FIG. 3A.

In this embodiment, each pressure chamber 36 is held in communication at its longitudinal end portion 36*a* with the corresponding nozzle 4, and is held in communication at another longitudinal end portion 36*b* with a common chamber 7, as shown in FIGS. 2, 3B and 3C. Each pressure chamber 36 has a length L1 of about 4 mm and a width W1 of about 0.25 mm. Each adjacent pair of the pressure chambers 36 are separated by a partition wall 39 interposed therebetween. The partition wall 39 has a width W2 of about 0.1 mm as measured in the X-axis direction.

The pressure chambers 36 are held in communication at the respective longitudinal end portions 36*a* with the respective nozzles 4 through respective ink delivery passage in the form of through-holes 37 which are formed through the four spacer plates 15-18, two manifold plates 14X, 14Y, damper plate 13 and first spacer plate 12. The through-holes 37 are arranged in a zigzag pattern, like the nozzles 4 and the pressure chambers 36.

The fifth spacer plate 18, which is held in contact with a lower surface of the base plate 19, has ink supply holes in the form of communication holes 38 formed therethrough to be positioned in respective positions corresponding to the other longitudinal end portions 36*b* of the respective pressure chambers 36. The communication holes 38 are thus connected to the longitudinal end portions 36*b* of the respective pressure chambers 36.

The fourth spacer plate 17, which is held in contact with a lower surface of the fifth spacer plate 18, defines horizontally extending connection passages 40 through which the ink is supplied from the common chamber 7 to the respective pressure chambers 36. Each of the connection passages 40 is connected at its inlet portion with a communication hole 41 which is formed through the second and third spacer plates 15, 16, and is connected at its outlet portion with the above-described communication hole 38. Each connection passage 40 has a flow restrictor portion which is located between the inlet and outlet portions, and a cross sectional area which is made relatively small in the flow restrictor portion for applying a resistance to a flow of the ink. It is noted that the communication hole 38, connection passage 40 and communication hole 41 cooperate with each other to constitute each one of ink delivery passages.

The two manifold plates 14X, 14Y cooperate to partially define four common chambers 7 which are formed through the entire thickness of each of the two manifold plates 14X, 14Y. The four common chambers 7 are elongated in the above-described X-axis direction, so as to extend along the respective rows of the nozzles 4 which also extend in the X-axis direction. The four common chambers 7 are defined by the two manifold plates 14X, 14Y superposed on each other, the second spacer plate 15 superposed on an upper surface of the manifold plate 14Y, and the damper plate 13 underlying a lower surface of the manifold plate 14X.

Each of the common chambers 7 formed in the manifold plates 14X, 14Y lies on a plane which is parallel with a plane defining the rows of the pressure chambers 36. Each common chamber 7 is elongated in a direction substantially parallel with the rows of the pressure chambers 36, and has a portion which overlaps the pressure chambers 36 arranged in a corresponding one of the rows, as viewed in the vertical direction, i.e. a direction perpendicular to the nozzle opening surface of the cavity unit 1. The common chamber 7 has, in its major portion, widthwise opposite ends 7*a*, 7*b* which are both parallel with each other in the plan view, as shown in FIG. 3A. The common chamber 7 is held in communication at one of its longitudinally opposite end portion with an ink supply hole 47, and has a cross section which is perpendicular to the longitudinal direction of the common chamber 7 and which varies in the other longitudinal end portion 7*c* and its vicinity. That is, in the other longitudinal end portion 7*c* and its vicinity, an area of the cross section of the common chamber 7 is gradually reduced as viewed in a direction away from the longitudinal end portion toward the other longitudinal end portion 7*c*. In the present embodiment, the width of the common chamber 7 is gradually reduced as viewed in the direction away from the longitudinal end portion toward the other longitudinal end portion 7*c*, as shown in FIG. 3A.

A pair of auxiliary open-space chambers 43 are formed in the manifold plates 14X, 14Y, so as to be adjacent to a portion (i.e., the above-described other longitudinal end portion 7*c* and its vicinity) of the common chamber 7 which is located in a region indicated by reference sign A in FIG. 3A and in which the cross sectional area of the common chamber 7 is gradually reduced. The auxiliary open-space chambers 43, each having a substantially triangle shape as viewed in the plan view, are located on respective opposite sides of the above-described portion of the common chamber 7 as viewed in the Y-axis direction. The auxiliary open-space chambers 43 are separated from the common chamber 7 by respective thin partition walls 44 which are interposed between the common chamber 7 and the auxiliary open-space chambers 43. The auxiliary open-space chambers 43 are thus provided to reduce a variation in the rigidity of the manifold plates 14X, 14Y.

The second spacer plate 15 has a rigidity adjuster in the form of a total of eight open-space chambers 42, which are provided by recesses formed (half-etched) on an upper surface of the second spacer plate 15 and having respective bottoms parallel with the upper surface of the second spacer plate 15. The open-space chambers 42 are elongated in the X-axis direction, i.e., in the direction parallel with the rows of the pressure chambers 36 and corresponding to the longitudinal direction of the common chambers 7. Described more specifically, each of the open-space chambers 42 is located between the pressure chambers 36 and the common chambers 7 in the direction perpendicular to the nozzle opening surface of the cavity unit 1, and is isolated from the pressure chambers 36 and the common chambers 7, as shown in FIGS. 3B and 3C. A distance between the open-space chambers 42 and the common chambers 7 as measured in the direction perpendicular to the nozzle opening surface of the cavity unit 1 is slightly smaller than one-seventh of a distance between the open-space chambers 42 and the pressure chambers 36 as measured in the direction perpendicular to the nozzle opening surface of the cavity unit 1. Each open-space chamber 42 overlaps the pressure chambers 36 arranged in the corresponding row as viewed in the direction perpendicular to the nozzle opening surface of the cavity unit 1, such that the pressure chambers 36 overlap the open-space chamber. 42, substantially equally with each other. Each open-space chamber 42 has a length slightly larger than the corresponding common chambers 7 and the corresponding row of the pressure chambers 36, and includes a portion extending between opposite ends of the corresponding row of the pressure chambers 36. Each open-space chamber 42 has a width which is substantially constant over its substantially entire length or which is substantially constant at least in the above-described portion extending between the opposite ends of the row of the pressure chambers 36.

As shown in FIG. 3A, each of the common chambers 7 overlaps two of the open-space chambers 42 located on opposite sides of the corresponding row of the communication holes 41 which are connected to a widthwise central portion of the common chamber 7. Each of the open-space chambers 42 has a longitudinal end portion which is located in the above-described region A, and which overlaps not only the corresponding common chamber 7 but also the corresponding auxiliary open-space chamber 43 and partition wall 44, as viewed in the plan view.

As shown in FIGS. 2, 3B and 3C, the damper plate 13, underlying the manifold plate 14X, has a total of four damper chambers 45 which are provided by recesses formed on a lower surface of the damper plate 13, such that the damper chambers 45 are isolated from the common chamber 7. The damper chambers 45 overlap the respective common chambers 7, as viewed in the plan view.

The formations of the above-described through-holes and recesses in the plates 12-19 for defining the common chambers 7, through-holes 37, communication holes 38, connection passages 40, communication holes 41, open-space chambers 42, auxiliary open-space chambers 43 and damper chambers 45 are made, for example, by electrolytic etching, electrical discharge machining, plasma jet machining or laser machining.

The base plate 19 has the ink supply holes 47 formed through its longitudinal end portion, as shown in FIG. 1. The ink supplying holes 47 are held in communication with the longitudinal end portions (not shown) of the respective common chambers 7 via respective through-holes (not shown) formed through the plates 15-18, so that the ink is supplied to the common chambers 7 from ink tanks which are provided outside the print head. In this sense, each of the ink supply holes 47 is located on the upstream side of the corresponding common chamber 7, as viewed in a direction of flow of the ink. After being supplied to each common chamber 7, the ink is distributed to the above-described other longitudinal end portions 36*b* of the respective pressure chambers 36 via the respective communication holes 41, connection passages 40 and communication holes 38. The ink thus supplied to each of the pressure chambers 36, upon activation of the corresponding active portion of the actuator unit 116, is delivered to the corresponding nozzle 4 via the corresponding through-hole 37.

On the other hand, the piezoelectric actuator unit 2 is a laminar structure consisting of a plurality of piezoelectric sheets and a top sheet superposed on each other. On an upper surface (i.e., surface having a relatively large width) of a lowermost one of the piezoelectric sheets each having a thickness of about 30 μm, there are formed individual electrodes in the form of elongated strips which are aligned with the respective pressure chambers 36 of the cavity unit 1 and which are arranged in four rows parallel to the longitudinal direction of the piezoelectric sheet, i.e., the X-axis direction. Each of the individual electrodes in the four rows is elongated in the Y-axis direction (that is perpendicular to the X-axis direction). The first row of individual electrodes and the fourth row of individual electrodes are located near the respective opposite long side edges of the piezoelectric sheet. The second row of individual electrodes and the third row of individual electrodes are located in a widthwise central portion of the piezoelectric sheet between the first and fourth rows of individual electrodes. On an upper surface (i.e., surface having a relatively large width) of each of even-numbered ones of the piezoelectric sheets as counted from the lowermost one, there is formed a common electrode which is common to the plurality of pressure chambers 36. On an upper surface of the top sheet, there are formed surface electrodes 26 electrically connected to the individual electrodes, and surface electrodes 27 electrically connected to the common electrodes.

It is noted that the piezoelectric actuator unit 2 may be a laminar structure consisting of a larger number of piezoelectric sheets, like a piezoelectric actuator unit disclosed in JP-A-H04-341853 and U.S. Pat. No. 5,402,159.

The lower surface of the piezoelectric actuator unit 2 (i.e., the surface opposed to the pressure chambers 36) is entirely covered by an adhesive layer or sheet (not shown) formed of an ink impermeable synthetic resin, and the actuator unit 2 is then bonded at the adhesive layer or sheet to the upper surface of the cavity unit 1 such that the individual electrodes are aligned with the respective pressure chambers 36 formed in the cavity unit 1. Further, the flexible flat cable 3 is pressed onto the upper surface of the actuator unit 2, such that electrically conductive wires (not shown) of the flexible flat cable 3 are electrically connected to the surface electrodes 26, 27.

A predetermined voltage is applied between the individual electrodes and the common electrodes through the surface electrodes 26, 27, for polarizing local portions of the piezoelectric sheets which are sandwiched between the individual electrodes and the common electrodes. The thus polarized portions of the piezoelectric sheets function as the active portions of the actuator unit 2, so as to be elongated in the direction of lamination of the piezoelectric sheets, whereby the volumes of the pressure chambers 36 are reduced. As a result, the ink in the pressure chambers 36 is ejected as droplets through the nozzles 4, onto a print medium, so that an image in the form of ink dots is printed on the print medium.

In this instance, as a result of increase in the pressure in a selected one or ones of the pressure chambers 36 with activations of the corresponding active portion or portions of the actuator unit 2, the spacer plates 15-18 are forced to be elastically deformed at their portions interposed between the selected pressure chamber or chambers 36 and the corresponding common chamber or chambers 7. In the present embodiment, the elastic deformation of the spacer plate 15 (defining upper ends of the common chambers 7) is reduced owing to the open-space chambers 42 which are formed in the spacer plate 15 so as to be elongated in the longitudinal direction of the common chambers 7 (i.e., the direction perpendicular to the longitudinal direction of the pressure chambers 36) and overlap the pressure chambers 36 as viewed in the plan view. That is, the open-space chambers 42 serve as absorbers for absorbing the elastic deformation of the spacer plates 16-18 which are located above the open-space chambers 42. Therefore, each portion of the spacer plate 15 located between the corresponding row of the pressure chambers 36 and the corresponding common chamber 7 is elastically deformed by an amount that is constant as viewed in the direction of the row of the pressure chambers 36. This arrangement is effective to minimize a difference among the pressure chambers 36 with respect to their volumetric and pressure changes which are caused by the activation of the respective active portions of the actuator unit 2, thereby making it possible to substantially equalize the ink ejecting performances of the respective nozzles 4 with each other, irrespective of the locations of the corresponding pressure chambers 36. Further, owing to the open-space chambers 42 serving as the absorbers for absorbing the elastic deformation of the spacer plates 16-18, it is possible to restrain transmission of the increased pressure from the selected pressure chamber or chambers 36 to the adjacent pressure chambers 36, namely, restraining occurrence of a so-called "cross talk" between the adjacent pressure chambers 36.

Further, in the inkjet print head of the present embodiment, although the spacer plate 15 is partially supported by the partition walls 44 in the region A in which the cross sectional area of each common chamber 7 is gradually reduced, the rigidity of the spacer plates 15-18 in the region A is slightly reduced by the open-space chambers 42, so as to be close to the rigidity of, the spacer plates 15-18 in the region B. Although the spacer plates 16-18 are deformed as a result of the change of the pressure in the pressure chamber or chambers 36 with activations of the corresponding portion or portions of the actuator unit 2, the pressure change is damped or absorbed by the open-space chambers 42 which are formed in the spacer plate 15, thereby restraining transmission of the pressure change to the other pressure chambers 36, namely, retraining occurrence of the cross talk between the adjacent pressure chambers 36.

As described above, the damper chambers 45 are formed on the lower surface of the damper plate 13 which defines the lower ends of the respective common chambers 7. Therefore, the damper plate 13 has portions 46 which are thinned by the formations of the respective damper chambers 45. These thinned portions 46 of the damper plate 13 serve as damper portions, which can be freely oscillated or displaced either toward the common chambers 7 or toward the damper chambers 45 since the damper plate 13 is made of a metallic material elastically deformable. In this arrangement, even if the change in the pressure in the selected pressure chambers 38 is transmitted to the common chambers 7, the pressure change is absorbed or damped by oscillation or elastic deformation of the damper portions 46, whereby occurrence of the cross talk between the adjacent pressure chambers 36 is further effectively restrained.

Further, in the inkjet print head of the present embodiment, each pair of the open-space chambers 42 are located on respective opposite sides of the corresponding row of the ink delivery passages (each constituted by the communication hole 38, connection passage 40 and communication hole 41 so as to communicate the corresponding common chamber 7 with the pressure chambers 36 arranged in the corresponding row). This arrangement permits each open-space chamber 42 to be formed to be elongated in parallel with the longitudinal direction of the corresponding common chamber 7 without the open-space chamber 42 being interfered by the ink delivery passages. Therefore, each portion of the cavity unit 1 located between the corresponding row of the pressure chambers 36 and the corresponding common chamber 7 is given a rigidity that is constant as viewed in the direction of the row of the pressure chambers 36, whereby occurrence of the cross talk between the adjacent pressure chambers 36 is further effectively restrained.

Still further, in the inkjet print head of the present embodiment, each of the open-space chambers 42 is provided by the recess, which is formed on the upper surface of the second spacer plate 15 (i.e., on a surface opposed to neither the pressure chambers 36 nor the common chambers 7) such that the formed recess has a depth smaller than the entire thickness of the second spacer plate 15. Therefore, the open-space chambers 42 can be reliably isolated from the pressure chambers 36 and the common chambers 7, without having to increase the number of the plates superposed on each other.

While the preferred embodiment of the invention has been described in detail by reference to the accompanying drawings, it is to be understood that the invention is not limited to the details of the illustrated embodiment, but may be embodied with various other changes, modifications and improvements, which may occur to those skilled in the art.

What is claimed is:

1. An inkjet print head comprising a cavity unit and an actuator unit which are superposed on each other, wherein said cavity unit defines (a) a plurality of nozzles which are open in a nozzle opening surface of said cavity unit and which are arranged in at least one row, (b) a plurality of pressure chambers which are positioned in vicinity of said actuator unit and which are arranged in at least one row so as to be held in communication with the respective nozzles, and (c) at least one common chamber which stores an ink supplied from an ink supply source and refills said pressure chambers, wherein said actuator unit has a plurality of active portions which correspond to said pressure chambers, respectively, and which are selectively operable to eject the ink through the respective nozzles, wherein each of said at least one common chamber is elongated in a direction substantially parallel with a corresponding one of said at least one row of said pressure chambers, such that said plurality of pressure chambers arranged in the corresponding one of said at least one row overlap said each of said at least one common chamber as viewed in a direction perpendicular to said nozzle opening surface of said cavity unit, wherein said each common chamber is shaped such that at least one of said plurality of pressure chambers arranged in the corresponding row overlaps said each common chamber differently from the other of said plurality of pressure chambers arranged in the corresponding row, wherein said cavity unit further defines at least one open-space chamber which is located between said pressure chambers and said at least one common chamber in said direction perpendicular to said nozzle opening surface of said cavity unit, and which is isolated from said pressure chambers and said at least one common chamber, and wherein any one of said at least one open-space chamber overlaps all of said plurality of pressure chambers arranged in a corresponding one of said at least one row, as viewed in said direction perpendicular to said nozzle opening surface of said cavity unit, such that all of said pressure chambers arranged in any one of said at least one row overlap a corresponding one of said at least one open-space chamber substantially equally with each other.

2. The inkjet print head according to claim 1, wherein each of said at least one open-space chamber is elongated in said direction substantially parallel with a corresponding one of said at least one row of said pressure chambers, and includes a portion extending between opposite ends of the corresponding one of said at least one row of said pressure chambers, and wherein said each of said at least one open-space chamber has a width which is substantially constant at least in said portion extending between said opposite ends of the corresponding row of said pressure chamber.

3. The inkjet print head according to claim 1, wherein each of said at least one common chamber is held in communication at one of longitudinally opposite end portions thereof with said ink supply source, wherein said each of said at least one common chamber is shaped to have a cross section which is perpendicular to a longitudinal direction of said each common chamber, such that an area of said cross section is gradually reduced, as viewed in a direction away from said one of said longitudinally opposite end portions toward the other of said longitudinally opposite end portions, at least in said other of said longitudinally opposite end portions.

4. The inkjet print head according to claim 3, wherein said each of said at least one common chamber has a width which is gradually reduced, as viewed in said direction away from said one of said longitudinally opposite end portions toward the other of said longitudinally opposite end portions, at least in said other of said longitudinally opposite end portions.

5. The inkjet print head according to claim 3, wherein said cavity unit further defines at least one auxiliary open-space chamber each adjacent to a portion of a corresponding one of said at least one common chamber in which said area of said cross section is gradually reduced, such that said each of said at least one auxiliary open-space chamber is isolated from the corresponding one of said at least one common chamber, and wherein each of said at least one open-space chamber includes a portion overlapping a corresponding one of said at least one common chamber and one of said at least one auxiliary open-space chamber which is adjacent to the corresponding one of said at least one common chamber, as viewed in said direction perpendicular to said nozzle opening surface of said cavity unit.

6. The inkjet print head according to claim 1, wherein each of said at least one common chamber is held in communication with said plurality of pressure chambers arranged in a corresponding one of said at least one row, via a plurality of ink delivery passages which are arranged in a row extending in a longitudinal direction of said each of said at least one common chamber, and wherein said at least one open-space chamber includes a pair of open-space chambers which are located on respective opposite sides of said row of said ink delivery passages.

7. The inkjet print head according to claim 6, wherein each of said plurality of ink delivery passages is connected with a widthwise central portion of a corresponding one of said at least one common chamber.

8. The inkjet print head according to claim 6, wherein said pair of open-space chambers are isolated from each other.

9. The inkjet print head according to claim 1, wherein a distance between said at least one open-space chamber and said at least one common chamber as measured in said direction perpendicular to said nozzle opening surface of said cavity unit is smaller than a distance between said at least one open-space chamber and said plurality of pressure chambers as measured in said direction perpendicular to said nozzle opening surface.

10. The inkjet print head according to claim 9, wherein said distance between said at least one open-space chamber and said at least one common chamber is smaller than a half of said distance between said at least one open-space chamber and said plurality of pressure chambers.

11. The inkjet print head according to claim 1, wherein said cavity unit is a laminar structure including a plurality of plates which are superposed on each other, wherein said plurality of plates includes a pressure-chambers forming plate in which said plurality of pressure chambers are formed, an open-space-chamber forming plate in which said at least one open-space chamber is formed, and a common-chamber forming plate in which said at least one common chamber is formed, and wherein said open-space-chamber forming plate is located between said pressure-chambers forming plate and said common-chamber forming plate.

12. The inkjet print head according to claim 11, wherein said plurality of plates of said laminar structure includes a plurality of interposed plates which are interposed between said pressure-chambers forming plate and said common-chamber forming plate and which include said open-space-chamber forming plate, and wherein each of said at least one open-space chamber is defined by a recess formed on a surface of said open-space-chamber forming plate which surface is opposed to one of said plurality of interposed plates that is contiguous to said open-space-chamber forming plate.

13. The inkjet print head according to claim 11, wherein said plurality of plates of said laminar structure includes a plurality of interposed plates which are interposed between said pressure-chambers forming plate and said common-chamber forming plate and which includes said open-space-chamber forming plate, and wherein said open-space-chamber forming plate is contiguous to said common-chamber forming plate.

* * * * *